US008087363B2

(12) United States Patent
Clark et al.

(10) Patent No.: US 8,087,363 B2
(45) Date of Patent: Jan. 3, 2012

(54) RAIL CAR COLLISION SYSTEM

(75) Inventors: Peter Clark, Folsom, CA (US); Chad Hewitt, Folsom, CA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 12/704,263

(22) Filed: Feb. 11, 2010

(65) Prior Publication Data

US 2010/0199881 A1 Aug. 12, 2010

Related U.S. Application Data

(62) Division of application No. 11/786,813, filed on Apr. 12, 2007, now Pat. No. 7,690,314.

(51) Int. Cl.
*B61D 15/06* (2006.01)

(52) U.S. Cl. ..... 105/392.5; 105/396

(58) Field of Classification Search ..... 105/392.5, 105/394, 396; 213/220–222; 296/187.03, 296/187.08, 187.09; 293/133, 154
See application file for complete search history.

(56) References Cited

U.S. PATENT DOCUMENTS

| | | | | |
|---|---|---|---|---|
| 4,184,434 | A * | 1/1980 | Chapin | 105/456 |
| 5,579,699 | A * | 12/1996 | Dannawi et al. | 105/416 |
| 6,561,105 | B2 * | 5/2003 | Godin et al. | 105/396 |
| 6,688,237 | B2 * | 2/2004 | Back et al. | 105/392.5 |
| 6,712,007 | B2 * | 3/2004 | Yamamoto et al. | 105/392.5 |
| 2004/0159263 | A1 * | 8/2004 | Yamamoto et al. | 105/392.5 |
| 2007/0131135 | A1 * | 6/2007 | Moser et al. | 105/8.1 |
| 2007/0186802 | A1 * | 8/2007 | Gough | 105/392.5 |
| 2007/0261591 | A1 * | 11/2007 | Bravo et al. | 105/392.5 |
| 2008/0006173 | A1 * | 1/2008 | Mayer | 105/392.5 |
| 2008/0250965 | A1 * | 10/2008 | Clark et al. | 105/413 |
| 2008/0314282 | A1 * | 12/2008 | Malfent et al. | 105/392.5 |

FOREIGN PATENT DOCUMENTS

| | | | |
|---|---|---|---|
| EP | 1006034 | A1 * | 6/2000 |
| WO | WO 2004110842 | A1 * | 12/2004 |
| WO | WO 2006010176 | A1 * | 2/2006 |

* cited by examiner

*Primary Examiner* — Joe Morano, IV
*Assistant Examiner* — Jason C Smith

(57) ABSTRACT

A rail car collision system is disclosed that includes a front face and an underframe having a first anticlimber. The first anticlimber protrudes from and extends across at least a portion of the front face at a first position. At least one second anticlimber extends along at least a portion of the front face at a second position that is vertically different than the first position.

26 Claims, 10 Drawing Sheets

RAIL CAR COLLISION SYSTEM

This patent is a divisional of U.S. patent application Ser. No. 11/786,813, filed on Apr. 12, 2007 now U.S. Pat. No. 7,690,314, the content of which is hereby incorporated in its entitrety herein for all purpose.

BACKGROUND

This present invention relates to rail transit vehicles and, more specifically, to collision structures for use with rail transit vehicles.

Rail transportation utilizes various types of rail vehicles or cars. These cars include commuter rail, light rail and heavy rail cars. In accordance with regulations in place, federal or otherwise, such cars include structure to absorb the impact of collisions with other rail cars as well other roadway vehicles. One such structure is a coupler, which projects outwardly from the front face of the rail car. The coupler in a "front" car of the rail vehicle acts as a buffer to absorb the impact of a collision with another rail vehicle. Ideally, when two rail cars collide, the couplers associated with the front cars of each contact each other upon impact. The coupler for each car then absorbs the energy generated by the impact and distributes the remainder across the underframe of the car, thus reducing the damage to the car as a whole.

Another type of structure is an anticlimber located in or on a front face of a car, The anticlimber includes a grille. When two cars collide, the anticlimbers will contact each other and, similar to the coupler, will absorb the impact of a collision with another rail vehicle. At higher rates of impact, the grilles of the anticlimbers engage to reduce the likelihood that the cars will "climb" or otherwise be separated from the rails upon which they ride. However, regardless of the impact strength, each anticlimber absorbs the energy generated by the impact and distributes the remainder across the underframe of each car.

In order for these structures to be used successfully, however, the collision structures on both colliding rail cars must be located at the same height relative to the rails so that they contact each other. Otherwise, the structures may partially come into contact, or fail to contact each other at all.

Further explanation of the conventional structures described above is now provided. FIG. 1 shows a cutaway view of portions of two opposing rail cars 102, 104. Each railcar includes an anticlimber 106 extending across a front face 108 of the car 102, 104 and, optionally, includes a coupler 110 that projects outwardly from the rail car 102, 104. Both the anticlimber 106 and the coupler 110 reduce the loads on the rail car 102, 104 resulting from a collision. The anticlimber (and coupler) will absorb energy generated from a collision, thus reducing the amount of energy that is distributed across an underframe 112 of the car. Traditionally, and as shown in FIG. 2, when two rail cars 102, 104 collide, the anticlimbers 106 of each car come into contact and, at a sufficiently high impact, engage to prevent the cars 102, 104 from moving off of a track 113.

In order for the anticlimbers 106 of the colliding rail cars to be effective, they should be located at the same height H with respect to a horizontal plane (e.g., rail tracks), upon which they are positioned. For embodiments where couplers are included, the couplers should be also be positioned at the same height. However, because rail car structures often will differ from each other, particularly when one rail car is of a newer model than the other car, the anticlimbers may not be positioned at the same height. Under such circumstances, and as shown in FIGS. 1 and 3, the anticlimbers 106 (as well as the couplers 110 where used), of two colliding cars may, upon impact, only partially contact each other or not contact each other at all, resulting in the benefits of the traditional collision structures not being fully realized. Thus, the older cars may need to be replaced or significantly modified, which may incur considerable inconvenience and expense.

BRIEF SUMMARY

By way of introduction, the preferred embodiments described below include a rail car collision system having a front face and an underframe. The underframe includes a first anticlimber that protrudes from and extends across at least a portion of the front face. At least one second anticlimber extends along at least a portion of the front face at a second position that is vertically different than the first position.

An additional embodiment includes a rail car having a front face and a first anticlimber protruding from the front face. The first anticlimber is located at a first position relative to a horizontal plane. A second anti-climber is mounted along at least a portion of the front face at a second position relative to the horizontal plane, with the second position being vertically different than the first position.

An additional embodiment also discloses a method of assembling a collision structure for a rail car. The rail car includes a front face and an underframe. A first anticlimber is attached to the underframe at a first position relative to a horizontal plane, with the first anticlimber protruding from the front face. At least one second anticlimber is attached along the front face of the rail car at a second position relative to the horizontal plane, with the first position being vertically different than the second position.

The present invention is defined by the following claims, and nothing in this section should be taken as a limitation on those claims. Further aspects and advantages of the invention are discussed below in conjunction with the preferred embodiments.

BRIEF DESCRIPTION OF THE DRAWINGS

The components and the figures are not necessarily to scale, emphasis instead being placed upon illustrating the principles of the invention. Moreover, in the figures, like reference numerals designate corresponding parts throughout the different views.

DETAILED DESCRIPTION OF THE DRAWINGS AND PRESENTLY PREFERRED EMBODIMENTS

Figure 1:
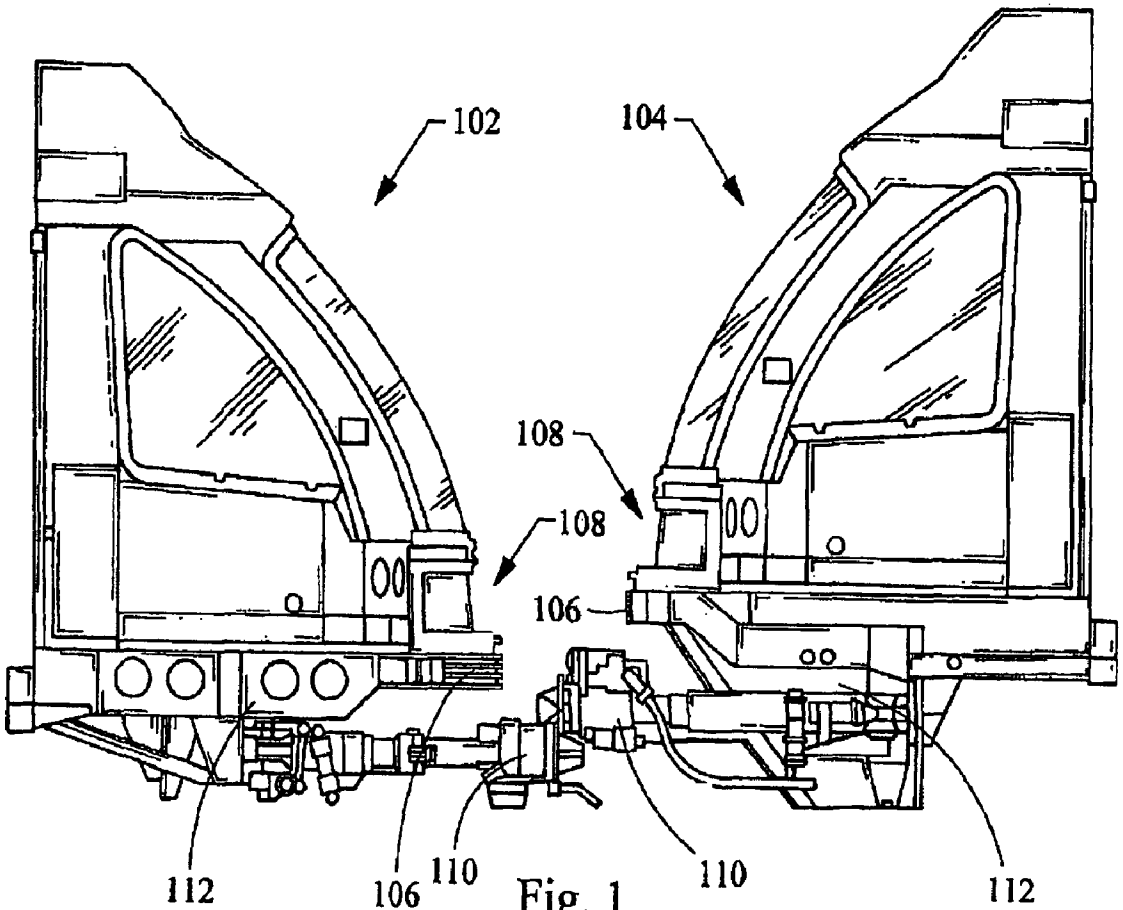
Fig. 1 (Prior Art)
FIG. 1 is a side view of prior art rail cars, with a portion of the cars removed.
Figure 2:
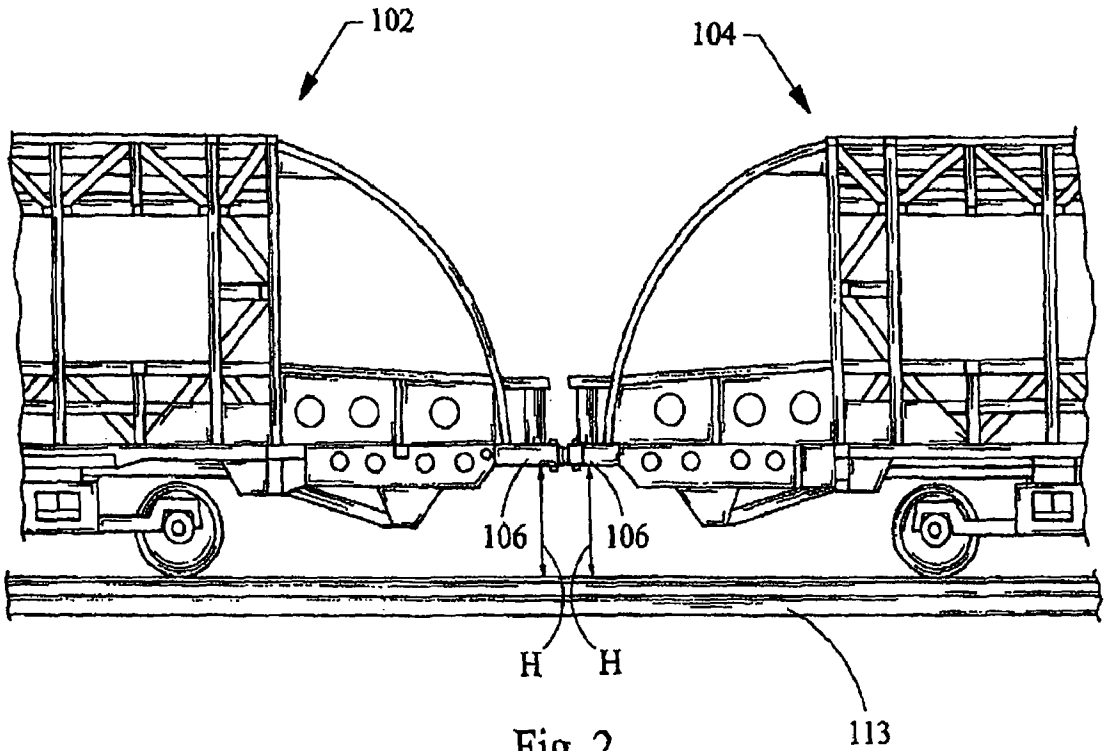
Fig. 2 (Prior Art)
FIG. 2 is a side view of compatible prior art rail cars colliding.
Figure 3:
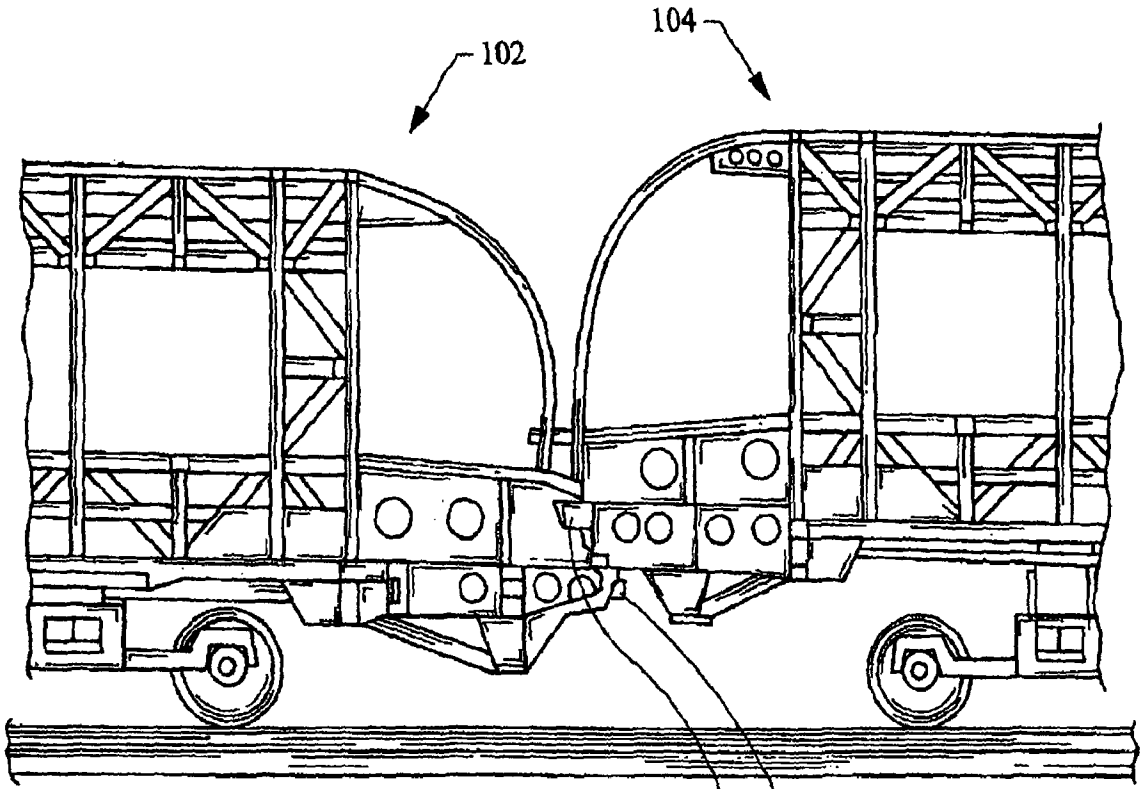
Fig. 3 (Prior Art)
FIG. 3 is a side view of incompatible prior art rail cars colliding.
Figure 4:
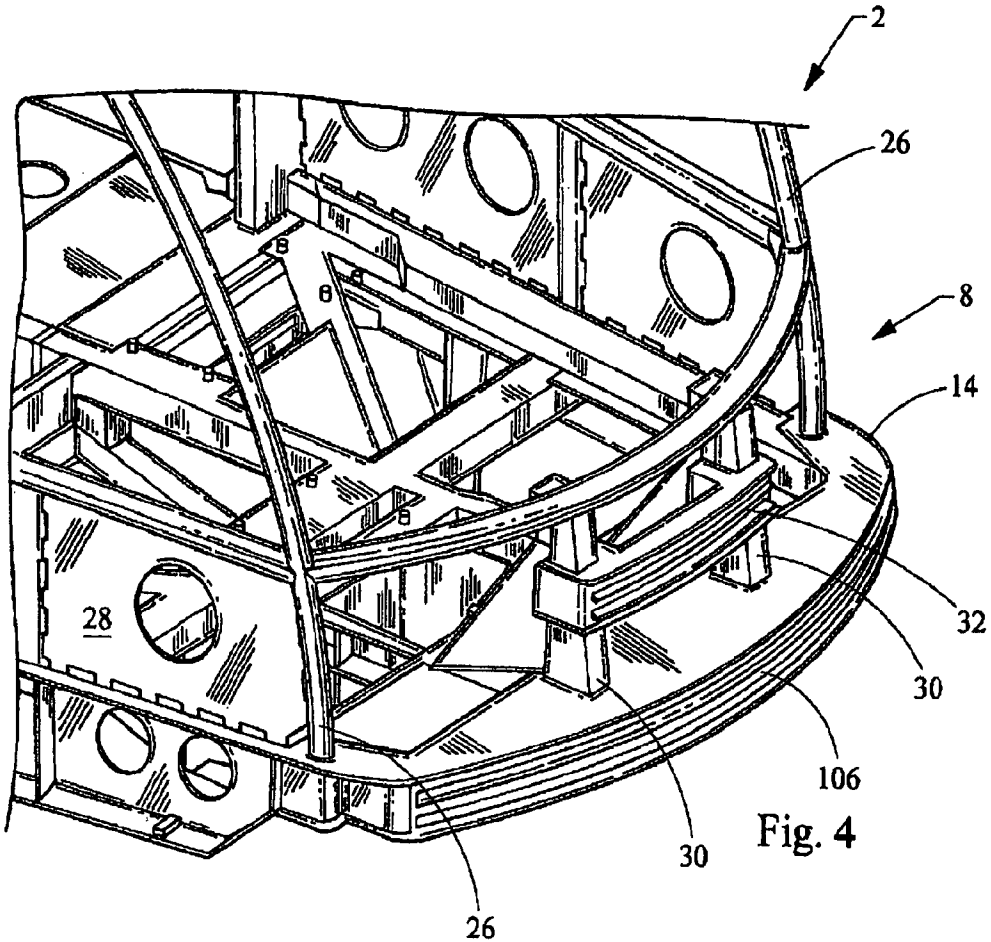
FIG. 4 is a perspective view of a rail car front end underframe.
Figure 5:
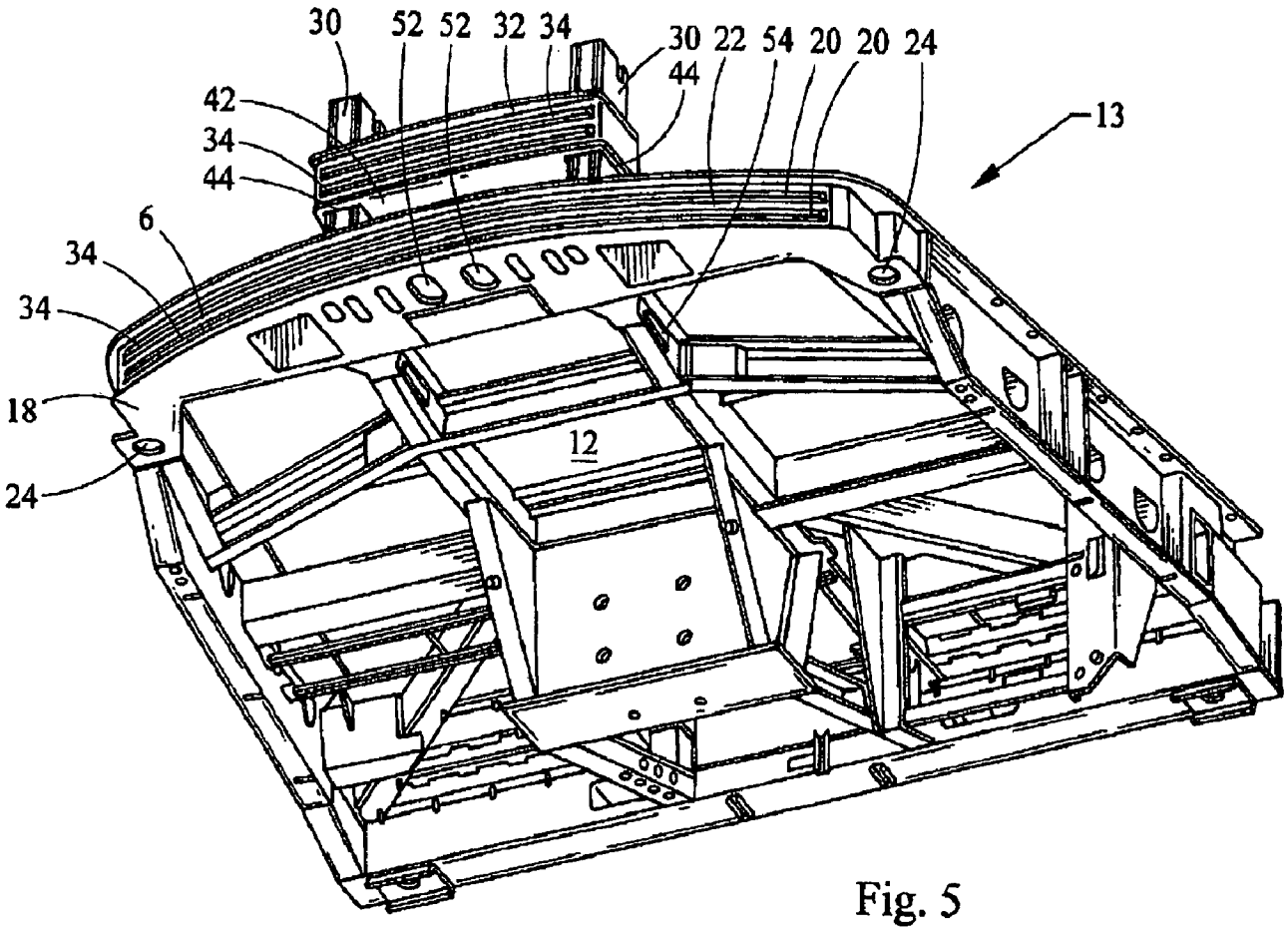
FIG. 5 is a bottom perspective view of a front end underframe.
Figure 6:
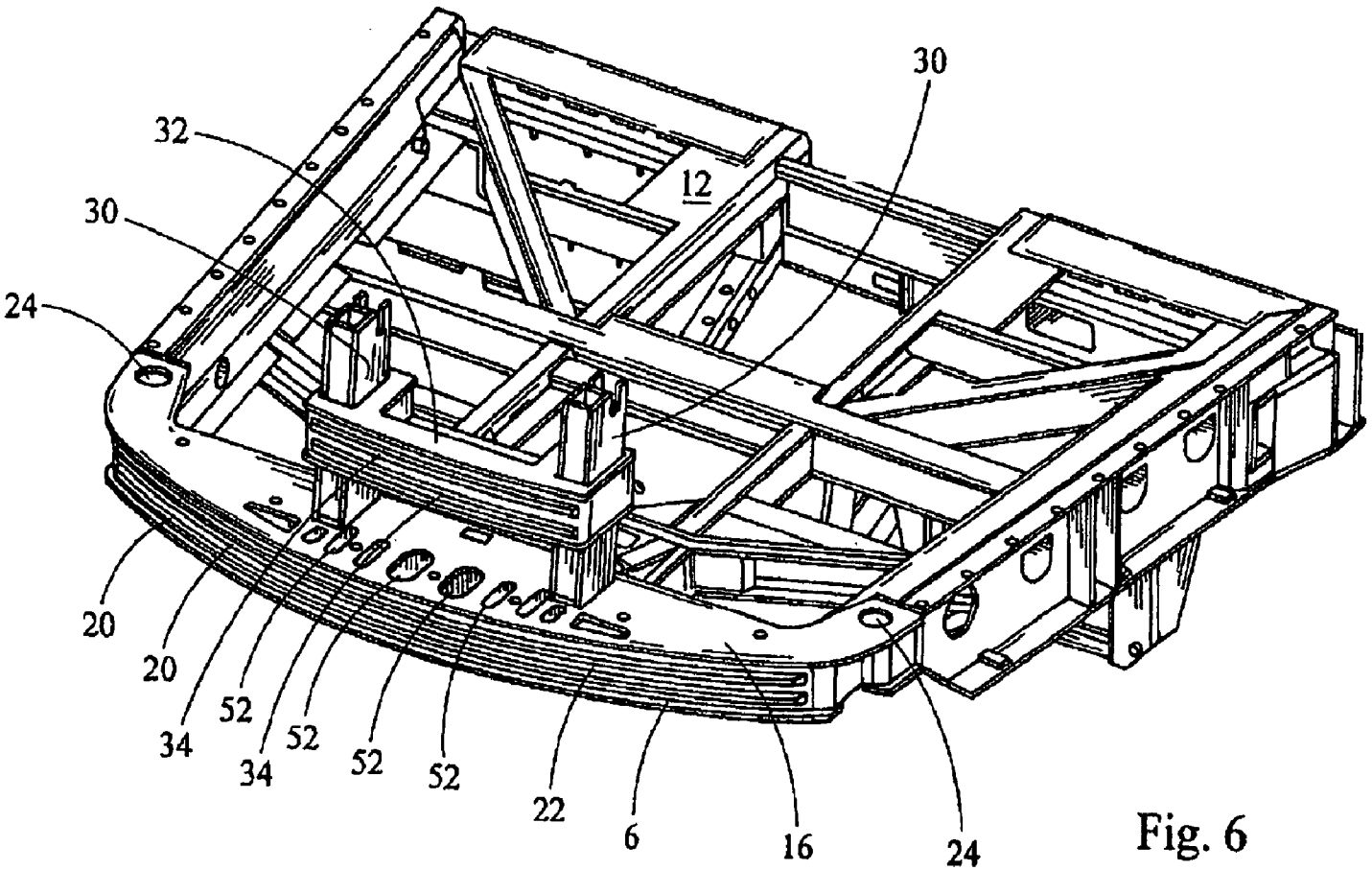
FIG. 6 is a top perspective view of the front end underframe of FIG. 5.

Referring now to FIGS. 4 through 6, a collision system is shown and described herein. A rail car 2 includes a front face 8. A first anticlimber 6 protrudes from and preferably extends across a lower portion 14 of the front face 8 and is contoured with the profile of the front face (see FIG. 5). The first anticlimber 6 is attached to a front portion 13 of an underframe 12. The first anticlimber includes a top face 16, a bottom face 18 and a plurality of ribs 20 that extend across the first anticlimber. In a preferred embodiment, there are two intermediate and two outer ribs. The plurality of ribs forms a grille 22.

The top and bottom faces 16, 18 of the first anticlimber 6 preferably include openings 24 shaped to receive a pair of outer posts 26 that form a part of a car frame 28, such that the first anticlimber 6 surrounds and are engaged with the outer posts 26. Moreover, the areas where the first anticlimber 6 and outer posts 26 interface are welded to each other to further strengthen the connection between the anticlimber 6 and outer posts 26. Although welding is preferred, in other embodiments, the first anticlimber 6 may be otherwise attached to the outer posts 26. Examples include without limitation, high-strength fasteners, tabs or adhesives. Moreover, in alternate embodiments, the first anticlimber 6 may extend across less than the entire front face.

The rail car 2 also includes a plurality of collision posts 30 that protrude upwardly from the top face 16 of the first anticlimber 6, with a preferred embodiment including two collision posts 30. While the collision posts 30 are not limited to a specific shape and height, and instead depend on design specifications, generally, the height of a collision post will be greater than its width. Moreover, while a preferred embodiment contemplates a trapezoidally-shaped collision post, in alternate embodiments, the collisions posts may be otherwise shaped. Examples of post shapes include, but are not limited to, rectangles, squares, circles and ovals. Moreover, in other embodiments there may be additional collision posts provided.

Generally, it is preferable that the collision posts 30 be centered and symmetrical with respect to the front face 8 of the rail car 2. However, depending on design specifications and aesthetic considerations, the collision posts 30 may be otherwise oriented. As explained further below, the collision posts 30 provide mountings for a second anticlimber 32.

Figure 7:
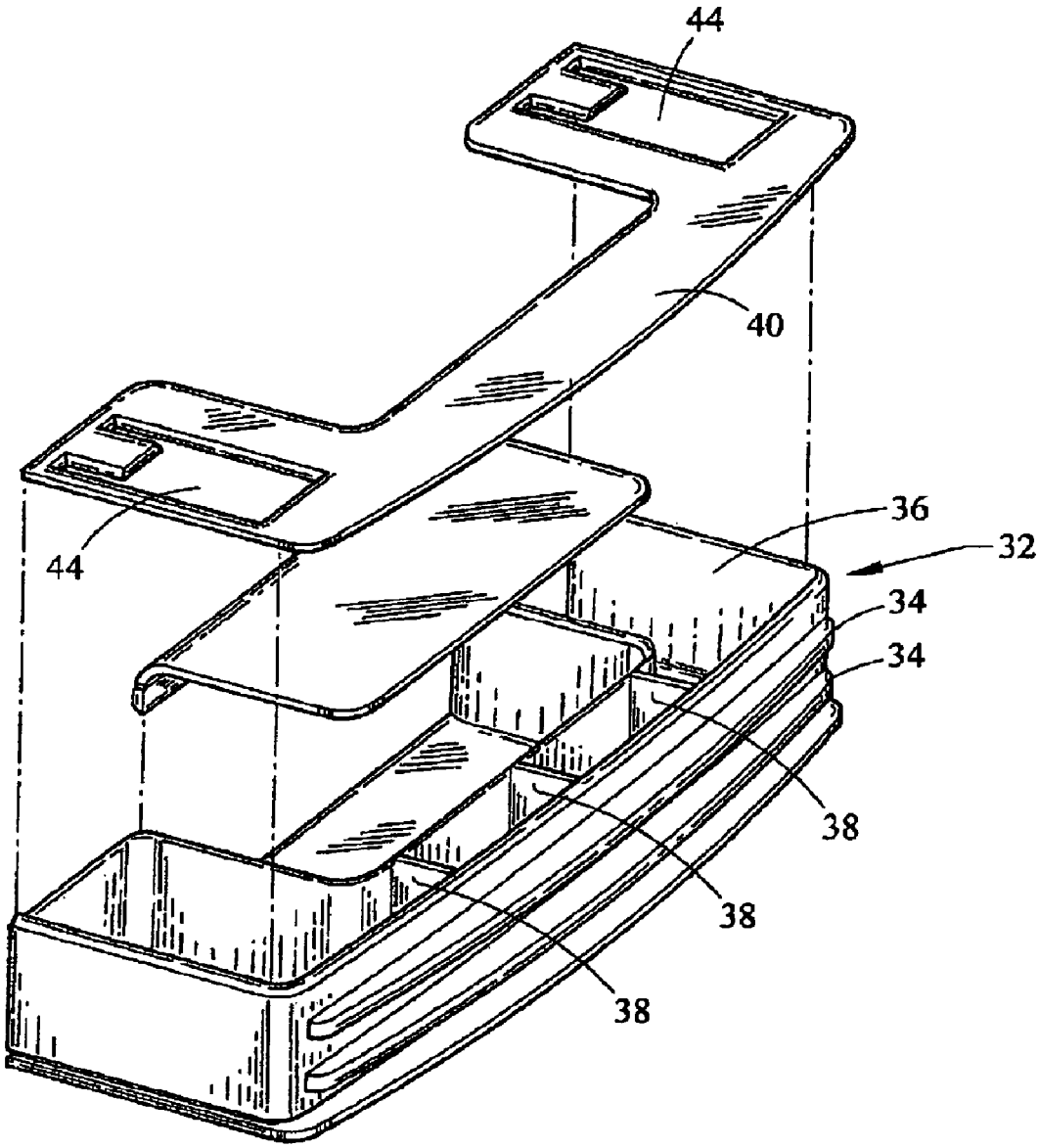
FIG. 7 is a perspective view of a second anticlimber.

Referring also now to FIG. 7, at least one second anticlimber 32 extends along at least a portion of the front face 8 and is attached to the collision posts 30. The second anticlimber 32 is similar to the first anticlimber 6 and includes a plurality of ribs 34 and, preferably, includes two intermediate ribs between two outer ribs. The second anticlimber 32 includes a cavity 36 having a plurality of stiffening plates 38, which, in one preferred embodiment, is u-shaped. The stiffening plates 38 add rigidity and strength to the second anticlimber 32. Notably, the size of the cavity 36 may be varied depending on the number of stiffening plates 38 desired as well as specification considerations, including those relating to the weight of the second anticlimber 32.

The second anticlimber 32 also includes a top face 40 and a bottom face 42 that each includes a pair of openings 44. The openings 44 are sized to receive with the collision posts 30 so that when engaged, the collision posts 30 pass through the second anticlimber 32 and are surrounded by the second anticlimber 32. Preferably, the areas where the anticlimber and collision posts engage are welded to each other in order to strengthen the connection of the second anticlimber and collision posts and to reduce the occurrence of stress failures. However, in alternate embodiments the second anticlimber may be otherwise attached to the collision posts in a fashion as described above with respect to the first anticlimber.

The second anticlimber 32 may be of any width and located anywhere along the front face, and most preferably, along the collision posts 30. The location of the second anticlimber generally will depend on the location of the collision systems of other cars so that, if the cars come into contact, the ribs of the second anticlimber are able to engage with the collision system of the opposing car. In one example relating to Type 4 Light Rail Vehicles (LRVs), 32 inches has been found to be an optimal width for the second anticlimber, such that it is able to conform to Federal Regulations without having to increase the width, which may require additional structure and, undesirably, add weight to the rail car. Furthermore the second anticlimber of the Type 4 LRVs is centered with respect to the top face of the first anti-climber, which, because the first anticlimber extends across the entire front face, means that the second anticlimber also is centered width-wise relative to the front face. Additionally, while the height of the second anticlimber also will depend on design considerations, it typically does not have a height not larger than the collision posts.

Figure 8:
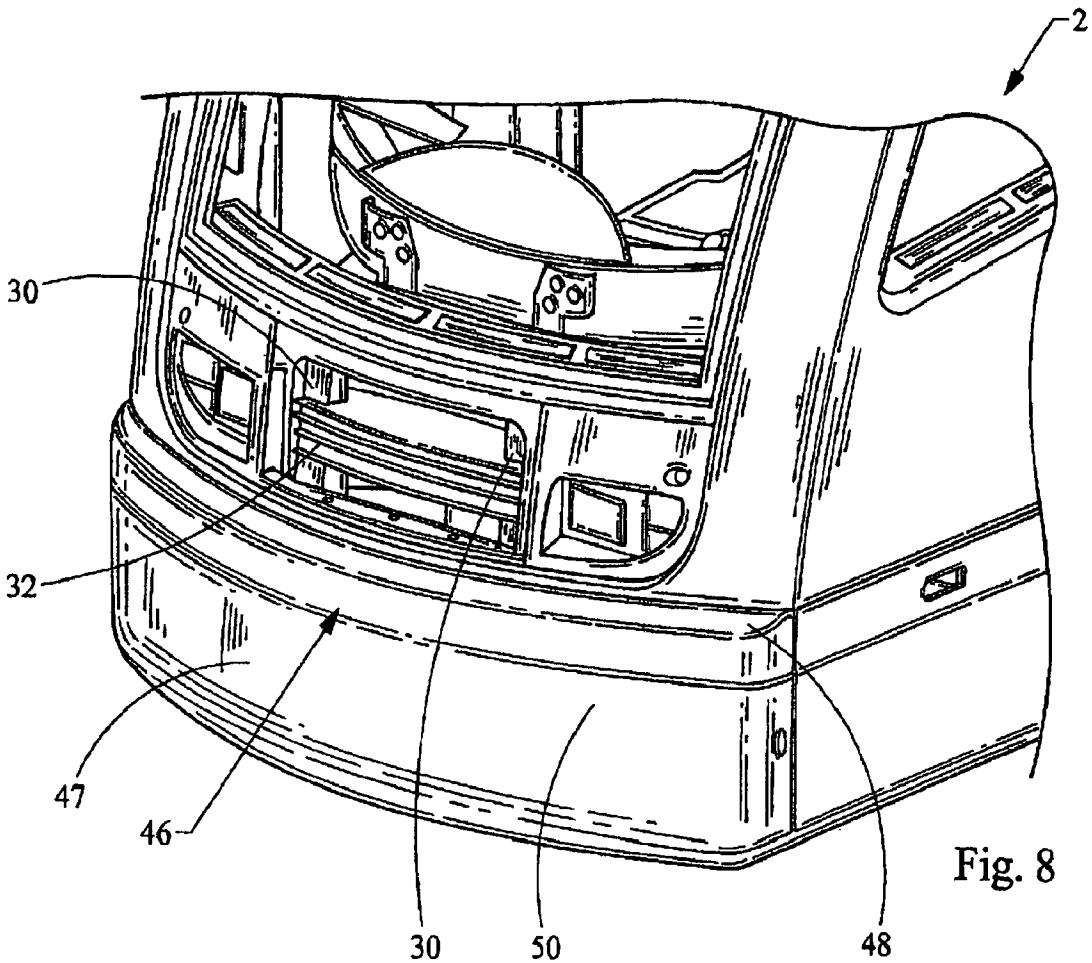
FIG. 8 is a partial perspective view of a rail car.

FIG. 8 shows one preferred embodiment of the second anticlimber 32 mounted to collision posts 30 and installed on a rail car 2. In this embodiment, the first anticlimber is located behind a mask 46. The mask 46 is provided for aesthetic reasons, and may be hinged either at its top 48 or bottom 50 to provide ease of access to the first anticlimber 6, as well as the underframe 12 of the car 2. In further embodiments, and depending on design considerations, a mask similarly may cover the second anticlimber without impeding upon the second anticlimber's function. As it may be not be desirable to add a significant amount of weight to the rail car, the mask may be made of fiber glass and basically such that it is sacrificed in the event of a collision. Similarly, a coupler cover 47 may be provided for rail cars that incorporate a coupler.

The collision system acts as follows, assuming incompatible rail cars. The term incompatible refers to a primary rail car and an opposing rail car have underframes differing in height relative a horizontal plane (e.g., rail tracks) upon which the cars rest. Typically, newer models of rail cars (in this instance the primary rail car) have under carriages positioned lower than those of older models. Each underframe has a first anticlimber mounted to it. However, because the cars are incompatible, the anticlimbers are not located at the same height relative to the rail tracks upon which they rest. In other words, the anticlimbers of each car are vertically offset from each other. In one example, relating to LRVs being of different models, this offset is approximately 310 millimeters (mm). In the event of two cars coming into contact, the offset would cause the anticlimbers to miss each other.

With the collision system described herein, the second anticlimber will be located on the rail car having the lower underframe. In the example provided above, the second anticlimber will be located on the primary rail car and will be located approximately 310 mm above the first anticlimber.

Figure 9:
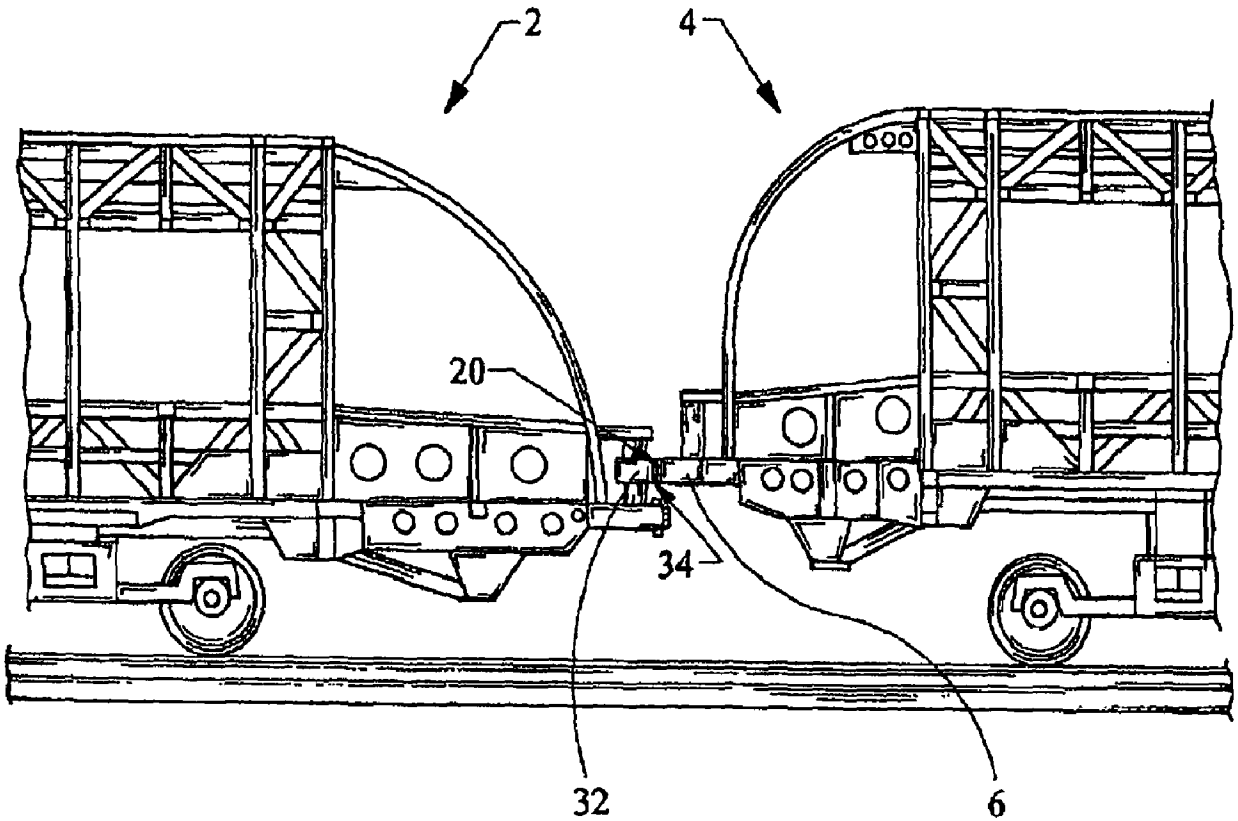
FIG. 9 is a side view of compatible rails cars colliding.

Thus, and as shown in FIG. 9, in the event of the cars contacting, the second anticlimber 32 of the primary car 2 contacts the first anticlimber 6 on the opposing car 4 to absorb the impact of the contact. At higher rates of impact, the plurality of ribs 34, 20, or grilles, of the second anticlimber 32 of the primary car 2 and the first anticlimber 6 of the opposing car 4, respectively, mesh and engage to prevent the rail cars from being lifted up from or otherwise vertically separated from each other or disengaging from the rail tracks.

As described above, the second anticlimber distributes impact loads incurred from a collision across the underframe of the rail car. To help minimize the damage to the underframe, a plurality of collapse zones 52, or openings, is located across the top face of the first anticlimber. Preferably, the collapse zones 52 extend through at least a portion of the first anticlimber and, more preferably, extend through the top and bottom faces 16, 18. When a collision occurs, the first anticlimber collapses into the collapse zones and absorbs the brunt of the impact to lessen the effects of impact on the remainder of the underframe. Moreover, the collapse zones assist in dissipating the energy generated from the impact so that the energy is not transferred through the remainder of the underframe. In addition to having collapse zones 52 on the first anticlimber, additional collapse zones 54 may be provided at other areas of the underframe 12. However, it is generally preferred that the collapse zones be provided towards a front portion 13 of the underframe 12 to minimize the loads to the underframe resulting from a direct impact.

To demonstrate the effectiveness of the anticlimber, a simulation was run using finite element models of an "older" LRV rail car and a "newer" LRV rail car, with the newer car having a lower underframe and anticlimber than the older car. A second anticlimber was included at the same height as the anticlimber on the older car. The simulation included having the newer car move at 20 miles per hour towards the older car while the older car remained stationary. When the newer car collided with the older car, 1.7 Mega Joules (MJ) of initial kinetic energy was created. Approximately 0.8 MJ was absorbed by the second anticlimber, with the rest being distributed through the underframe. The majority of structural collapse was absorbed by the collapse zones within the first 0.1 seconds. Moreover, the maximum post-impact crush, or collapse, realized by the newer car was approximately 310 mm, or 12 inches. The majority of this collapse occurred in the area of the collapse zones and forward of the collapse zones, with approximately 4 inches of collapse occurring behind the collapse zones.

Figure 10:
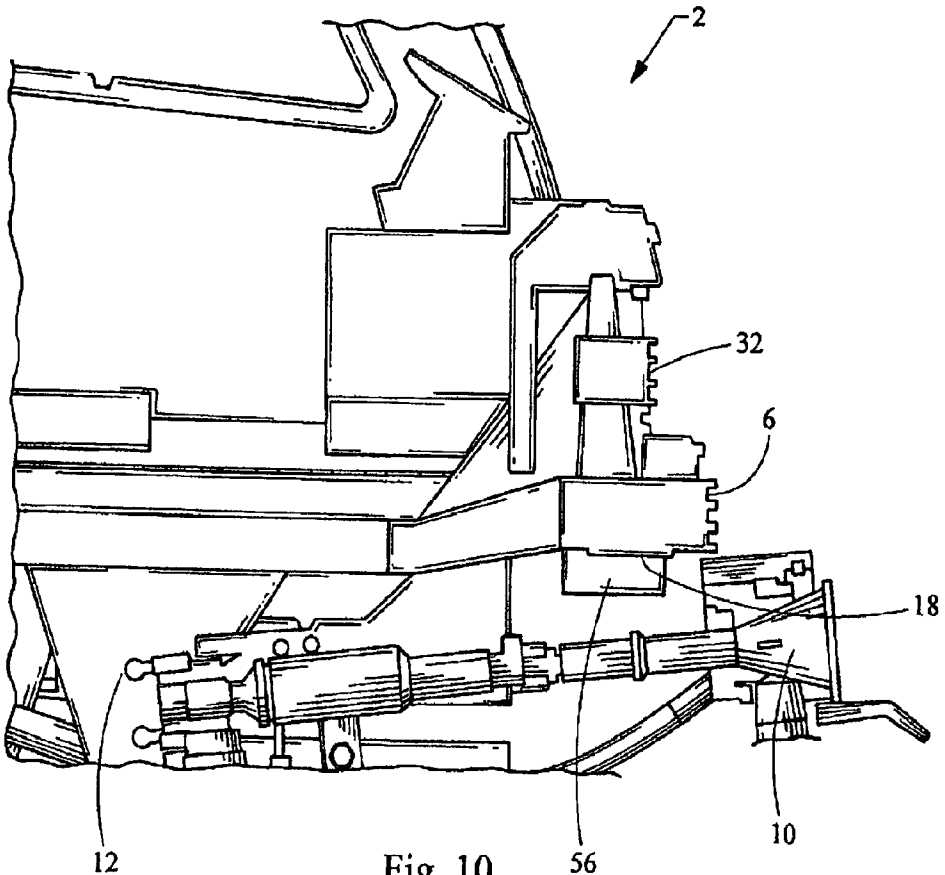
FIG. 10 is a side view of a rail car with a portion of the car removed.

FIG. 10 shows an alternate embodiment of a rail car having the second anticlimber 32 as well as including a coupler 10. As described above, the coupler 10 reduces the loads incurred by the rail car 2 in the event of a collision by distributing the loads across the underframe 12 of the car 2. An interface plate 56 is provided and is attached to the bottom face 18 of the first anticlimber 6. When coming into contact with another car, the interface plate 56 of the rail car 2 contacts and receives the coupler of an opposing car in the event the coupler of the opposing car only partially contacts or fails to contact the coupler of the other rail car, and thus reduces the probability of the coupler of the opposing car from directly impacting the underframe of the primary car. Similar to the second anticlimber, the interface plate absorbs and dissipates energy generated from a collision to reduce the damage to the underframe.

The material used to form the first and second anticlimbers and the interface plate is preferably a low-alloy, high-strength steel. However, in alternate embodiments other low-alloy, high-strength materials may be used.

Thus, a collision structure has been disclosed herein. The incorporation of a second anticlimber will provide an effective collision structure for a variety of rail cars. In the past, because newer rail cars often were incompatible with older rail cars, it was difficult to design rail cars in accordance with desired design specifications and yet conform to regulations involving collision standards. Often, older cars would have to be restructured, resulting in considerable inconvenience and expense.

In addition, the second anticlimber has been found to be an effective collision structure against road vehicles such as cars or trucks. The second anticlimber, or an additional second anticlimber, may be attached to the collision posts so that it will absorb energy resulting from a collision with a road vehicle, thus reducing the damage to the rail car.

While the invention has been described above by reference to various embodiments, it should be understood that many changes and modifications can be made without departing from the scope of the invention. For example, while the examples and embodiments described herein have contemplated an LRV car, the second anticlimber may be used with other types of rail cars. Examples include heavy rail cars and commuter rail cars.

It is therefore intended that the foregoing detailed description be regarded as illustrative rather than limiting, and that it be understood that it is the following claims, including all equivalents, that are intended to define the spirit and scope of this invention.

We claim:

1. A rail car collision system, comprising:

a front face;

an underframe including a first anticlimber, the first anticlimber protruding from and extending across at least a portion of the front face at a first position; and at least one second anticlimber extending along at least a portion of the front face at a second position that is substantially parallel to and vertically different than the first position, wherein each second anticlimber is engaged with at least two of a plurality of collision posts.

2. The rail car collision system of claim 1, wherein then plurality of collision posts extend from a top face of the first anticlimber.

3. The rail car collision system of claim 2, wherein the at least two of the plurality of collision posts are symmetrically positioned with respect to the first anticlimber.

4. The rail car collision system of claim 2, wherein the at least one second anticlimber is welded to the at least two of the plurality of collision posts.

5. The rail car collision system of claim 2, wherein the at least one second anticlimber is fastened to the at least two of the plurality of collision posts.

6. The rail car collision system of claim 2, wherein the height of each second anticlimber is less than the height of the at least two of the plurality of collision posts.

7. The rail car collision system of claim 1, wherein each second anticlimber further comprises at least two ribs.

8. The rail car collision system of claim 1, each second anticlimber is made of steel.

9. The rail car collision system of claim 1, further comprising an interface plate attached to the first anticlimber.

10. The rail car collision system of claim 1, wherein each second anticlimber has a width of 32 inches.

11. The rail car collision system of claim 1, wherein the first anticlimber includes a plurality of collapse zones that pass at least partially through the first anticlimber.

12. A rail car including a including a front face and a first anticlimber protruding from the front face and located at a first position relative to a horizontal plane, wherein the improvement comprises:

at least one second anticlimber mounted along at least a portion of the front face at a second position substantially parallel to the horizontal plane, wherein the second position is vertically different than the first position, and wherein each second anticlimber is engaged with at least two of a plurality of collision posts.

13. The rail car of claim 12, wherein the plurality of collision posts extends from the first anticlimber.

14. The rail car of claim 13, wherein the at least two of the plurality of collision posts are symmetrically positioned with respect to the first anticlimber.

15. The rail car of claim 13, wherein the height of each second anticlimber is less than the height of the at least two of the plurality of collision posts.

16. The rail car of claim 13, wherein each second anticlimber is welded to the at least two of the plurality of collision posts.

17. The rail car of claim 12, further comprising an interface plate attached to the first anticlimber.

18. The rail car of claim 12, wherein each second anticlimber further comprises a cavity and a plurality of stiffeners within the cavity.

19. The rail car of claim 12, wherein the first anticlimber includes a plurality of collision zones that pass at least partially through the first anticlimber.

20. The rail car of claim 12 further comprising a light rail vehicle car.

21. A method of assembling a collision structure for a rail car, the rail car having a front face and an underframe, the method comprising:

attaching a first anticlimber to the underframe at a first position relative to a horizontal plane, the first anticlimber protruding from the front face;

attaching at least one second anticlimber along the front face of the rail car at a second position substantially parallel to the horizontal plane, wherein the first position is vertically different than the second position; and engaging each second anticlimber with at least two collision posts.

22. The method of claim 21, wherein attaching at least one second anticlimber along the front face of the rail car further comprises:

attaching the collision posts to the first anticlimber.

23. The method of claim 21, wherein attaching at least one second anticlimber along the front face of the rail car at the second position further comprises: centering the at least one second anticlimber with respect to the front face of the rail car.

24. The method of claim 21, wherein attaching at least one second anticlimber along the front face of the rail car at the second position further comprises:

centering the at least one second anticlimber with respect to the first anticlimber.

25. The method of claim 21, further comprising:

forming a plurality of collapse zones through at least a portion of the first anticlimber.

26. A rail car collision system, comprising:

a railcar including a front face;

an underframe configured to carry the railcar, the under frame comprising:

a first anticlimber extending across and parallel to at least a portion of the front face; and a second anticlimber extending across at least a portion of the front face and wherein the second anticlimber is positioned parallel to and vertically away from the first anticlimber and is engaged with at least two of a plurality of collision posts.

* * * * *